US007144278B2

(12) United States Patent
Le Gallic et al.

(10) Patent No.: US 7,144,278 B2
(45) Date of Patent: Dec. 5, 2006

(54) PLUG CONNECTOR EQUIPPED WITH COMPRESSION CONTACT TERMINALS

(75) Inventors: Hervé Le Gallic, Cherreau (FR); Janvier Gassies, Nuille le Jalais (FR); Damien Sejourne, La Bazoge (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/541,600

(22) PCT Filed: Jan. 6, 2004

(86) PCT No.: PCT/FR2004/050003

§ 371 (c)(1),
(2), (4) Date: Dec. 23, 2005

(87) PCT Pub. No.: WO2004/006650

PCT Pub. Date: Aug. 5, 2004

(65) Prior Publication Data

US 2006/0148328 A1 Jul. 6, 2006

(30) Foreign Application Priority Data

Jan. 7, 2003 (FR) ..... 03 00200

(51) Int. Cl.
*H01R 13/24* (2006.01)

(52) U.S. Cl. ..... 439/700; 439/824

(58) Field of Classification Search ..... 439/700, 439/824, 862, 482

See application file for complete search history.

(56) References Cited

U.S. PATENT DOCUMENTS 5,540,599 A 7/1996 Bishop ..... 439/289
5,807,123 A * 9/1998 Spiegelaar et al. ..... 439/188
5,967,856 A * 10/1999 Meller ..... 439/700
6,071,141 A 6/2000 Semmeling et al. ..... 439/353
6,083,059 A * 7/2000 Kuan ..... 439/862
6,312,295 B1 * 11/2001 Nishimatsu ..... 439/700
6,524,140 B1 * 2/2003 Takagi et al. ..... 439/700

FOREIGN PATENT DOCUMENTS

EP 490860 A1 6/1992
EP 1 126 554 A2 8/2001
EP 1 168 514 A1 1/2002
EP 1 220 370 A1 7/2002

* cited by examiner

*Primary Examiner*—Hae Moon Hyeon
(74) *Attorney, Agent, or Firm*—Harrington & Smith, LLP

(57) ABSTRACT

The invention concerns a plug connector (1) equipped with compression contact terminals (5). In order to clean each of the contact surfaces of at least one first compression contact terminal (5) of a plug connector (1) and of a second contact terminal (9) of a connector with fixed base (2) respectively, the invention provides for at least one first contact terminal (5) of the plug connector including a contact end (8), Which contact end is provided with at least protuberance (12) mounted at the tip of its elongated part (16) extending in a plane perpendicular to an elongation axis (13) of said contact end and/or to a connection axis (15). Said protuberance comprises a cut out panel (38) to cause a forced lateral displacement of the contact end when said protuberance is urged to slide against an inner periphery (14) of the cavity, so as to obtain a reorientation of the elongation axis of the contact end relative to the connection axis upon electrical connection between the first contact terminal and the second contact terminal.

10 Claims, 1 Drawing Sheet

PLUG CONNECTOR EQUIPPED WITH COMPRESSION CONTACT TERMINALS

FIELD OF THE INVENTION

The invention concerns a plug connector provided with compression contact terminals. The object of the invention is to improve an electrical connection between a plug connector and a fixed-base connector. The invention is more particularly intended for the cell phone field, but could also be applied in other fields.

BACKGROUND OF THE INVENTION

A plug connector has an insulating body of plastic provided with cavities, which cavities are each designed to receive a first contact terminal or first contact element. A first contact terminal has, in particular, a connection end connected to a printed circuit board, an intermediate spring part, and a contact end designed to be connected to the fixed-base connector. An electrical connection can then be established during contact of the contact end of the plug connector with a surface of a second contact terminal or second contact element of the fixed-base connector.

An electrical connection between a first contact terminal of a plug connector and a second contact terminal of a fixed-base connector can be disrupted by the presence of dust particles in an area where contact is made between the first contact terminal and the second contact terminal.

In order to improve this electrical connection between at least one first contact terminal of the plug connector and the corresponding second contact terminal of the fixed-base connector, document U.S. Pat. No. 5,540,599, describes an electrical contact connector made in such a way that a cleaning action occurs during contact of a first contact element with a second contact element. The electrical connector has a first contact element provided with a contact surface and a second contact element also provided with another contact surface. The contact between the first contact element and the second contact element is made in such a way that when the respective surfaces of the first and second contact element are in contact with one another, the first contact element moves laterally relative to a principal axis of the first element. The first contact element also moves axially along this same principal axis of the first contact element. Thus, each contact surface of the first contact element and of the second contact element can be cleaned by sweeping the surface of the second contact element with the contact surface of the first contact element. This type of electrical contact connector has the advantage of being able to clean each of the contact surfaces of the first contact element and of the second contact element, but has the disadvantage that an imperfect electrical connection is made due to the fact that lateral and axial movements can be made by the first contact element against the contact surface of the second contact element during the electrical connection.

Another cleaning device described in document EP-A-0 490,860 is also known. In this document, an electrical contact device is described that also has a first contact element and a second contact element. The second contact element of this electrical contact device is part of a chip card, which chip card is designed to compress a spring during the electrical connection between the first contact element and the second contact element. The spring is compressed in such a way that the chip card undergoes a first movement and a second movement, the first movement being in a direction opposite the second movement. The first movement and the second movement are made longitudinally relative to the spring and the first contact element at a connection axis, at the same time as the first contact element is in contact with the second contact element. Thus, dust particles can be moved from the contact zone between the first contact element and the second contact element of the chip card at the moment of electrical connection. Nevertheless, a first pile of dust and a second pile of dust may appear on either side of the electrical connection zone between the first contact element and the second contact element of the chip card. The presence of these two piles of dust may then cause a poor electrical connection.

SUMMARY OF THE INVENTION

In order to resolve this electrical connection problem, the invention seeks to improve the electrical connection between at least one first contact terminal of a plug connector and one corresponding second contact terminal of a fixed-base connector. To do this, the invention provides for creating at least one first contact terminal comprising a contact end provided with at least one protuberance mounted at the end of an elongated part of the contact end and extending in a plane perpendicular to the elongation axis of this same contact end and/or to the connection axis. During electrical connection, the contact end is pushed in the direction of the connection end by compression of the spring. At the same time that the contact end is pushed, the protuberance slides to a stop against an inner periphery of the cavity, which inner periphery is formed by each cavity of the insulating body, so as to obtain a reorientation of an elongation axis of the contact end relative to the connection axis.

This protuberance is made in such a way that it has a cut-out face in order to force a lateral movement of the contact end when this protuberance slides against the inner periphery of the cavity. This protuberance is also made in such a way that the width of this contact end measured in an area of the first contact terminal where this protuberance is formed and measured perpendicularly to the connection axis is slightly smaller than the width of the cavity. In this way, the protuberance can be placed inside the cavity during electrical connection while being maintained with a slight play between the inner periphery of this same cavity and the protuberance.

The cut-out face formed by the protuberance permits the first contact terminal to be held in place inside the cavity so as to prevent this same terminal from possibly moving laterally or axially relative to the connection axis after electrical connection with the second corresponding contact terminal.

The subject of the invention therefore is a plug connector designed to be inserted into a fixed-base connector along a connection axis, comprising

- an insulating body provided with cavities, each of the cavities defining an inner periphery,
- at least one first compression contact terminal, elongated along an elongation axis and designed to be connected to the fixed-base connector by means of a corresponding second contact terminal, the first compression contact terminal being designed to be inserted into a cavity, and the first contact terminal comprising
- a connection end designed to be connected to a printed circuit board,
- an intermediate spring part, and a contact end designed to be connected to a corresponding second contact terminal of the fixed-base connector, characterized in that the contact end of the first contact terminal comprises at least one protuberance mounted at the end of its elongated part, which protuberance has a cut-out face to force a lateral movement of the contact end when this protuberance slides against the inner periphery of the cavity, resulting from the compression of the intermediate spring part when the contact end is brought into contact with a facial contact end of the second contact terminal.

BRIEF DESCRIPTION OF THE DRAWINGS

The invention will be better understood upon reading the description that follows and upon examination of the figures that accompany it. These are presented only by way of indication and do not at all limit the invention. The figures show.

DETAILED DESCRIPTION OF THE INVENTION

Figure 1:
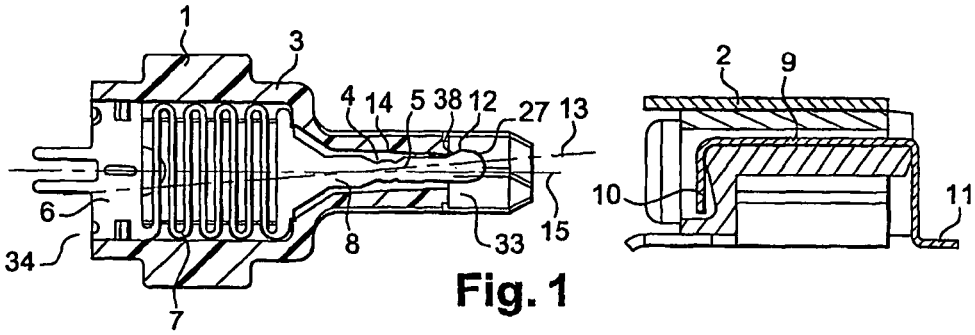
FIG. 1: A sectional view of a plug connector and a fixed-base connector, according to the invention.

FIG. 1 illustrates a plug connector 1 and a fixed-base connector 2, which plug connector and which fixed-base connector are designed to cooperate with one another to establish an electrical connection by means of at least one first contact terminal such as 5 and at least one second contact terminal such as 9, respectively. Plug connector 1 has an insulating body 3 provided with cavities, such as 4. Each cavity 4 is designed to receive a first contact terminal 5 relative to a connection axis 15. A connection axis 15 is an axis along which plug connector 1 and fixed base connector 2 are designed to join up in order to establish an electrical connection.

First contact terminal 5 is planar and has a shape elongated along connection axis 15. This first contact terminal comprises, relative to connection axis 15, a connection end 6, an intermediate spring part 7, and a contact end 8. Connection end 6 is designed to be connected to a printed circuit board (not shown) positioned against this same plug connector. Contact end 8 is designed to be connected to the fixed-base connector 2. This contact end 8 forms an elongated part 16 along an elongation axis 13, which elongated part 16 is terminated by a rounded edge 27. Rounded edge 27 delimits an overall rounded U shape.

Each cavity 4 of insulating body 3 forms a space adapted to the shape of the first contact terminal 5 while defining an inner periphery 14. Inner periphery 14 is made in such a way that it permits holding the first contact terminal 5 inside cavity 4. The first contact terminal 5 is held inside cavity 4 by means of the intermediate spring part 7 which is supported from connection end 6 up to contact end 8 against a first projection 30 and against a second projection 31 on one side, and against a shoulder 25 on the other side. First projection 30 and second projection 31 extend into the plane formed by the first contact terminal 5 without joining up, starting from inner periphery 14 perpendicularly to connection axis 15. Shoulder 25 is made in an area of cavity 4 situated at a junction between intermediate part 7 and contact end 8. This shoulder 25 creates a localized constriction of the cavity preventing intermediate part 7 from leaving cavity 4.

Contact end 8 is designed to be placed in contact with a second contact terminal 9 of fixed-base connector 2. This second contact terminal 9 comprises a facial contact end 10 and a contact tail 11. Facial contact end 10 is designed to be in contact with the first contact terminal 5 of plug connector 1 and contact tail 11 is designed to be connected to a printed circuit by soldering the contact tail with tracks of this same printed circuit (not shown). More precisely, rounded edge 27 of contact end 8 is designed to come into contact with a surface or end of facial contact 10 of second contact terminal 9 of the fixed-base connector 2.

Figure 2:
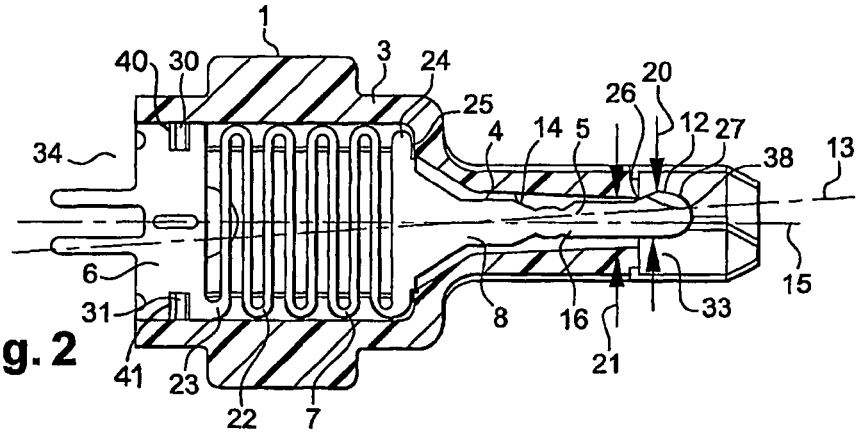
FIG. 2: A sectional view of a plug connector according to the invention, electrically disconnected.

According to the invention, contact end 8 has at least one protuberance 12 mounted at the end of its elongated part 16 while extending in a plane perpendicular to elongation axis 13 of this same contact end and/or to connection axis 15. More precisely, this protuberance 12 can be formed in the plane of first contact terminal 5. This protuberance 12 is formed starting from rounded edge 27 of the contact end and is designed to slide to a stop against inner periphery 14 of cavity 4 of insulating body 3. Protuberance 12 is made in such a way that a reorientation of elongation axis 13 of contact end 8 can be obtained relative to connection axis 15 during electrical connection of the first contact terminal 5 with the second contact terminal 9 (FIGS. 1 and 2). More particularly, this protuberance 12 has a cut-out face 38, this cut-out face being made in such a way that it permits forcing a lateral movement of contact end 8 relative to connection axis 15 when this protuberance 12 slides against inner periphery 14 of the cavity by means of cut-out face 38. This forced lateral movement permits obtaining a reorientation of elongation axis 13 of contact end 8 relative to connection axis 15.

Contact end 8 is positioned inside cavity 4 in such a way that elongated part 16 is slightly inclined relative to connection axis 15. More precisely, elongated axis 13 is slightly inclined relative to connection axis 15 inside cavity 4. Intermediate spring part 7 comprises a series of coils such as 22. Intermediate part 7 begins by a first coil 23 and ends by a last coil 24, from connection end 6 to contact end 8. The last coil 24 comes to rest against shoulder 25 formed in the cavity so as to incline elongation axis 13 relative to connection axis 15. More precisely, last coil 24 is placed on the same side as that where protuberance 12 is formed, relative to a plane perpendicular to the plane formed by contact terminal 5 and passing through connection axis 15 and/or through elongation axis 13.

Cavity 4 delimits an inlet 33 and an outlet 34. Inlet 33 is an area of the cavity near contact end 8 and the outlet is an area of the cavity distant from this same contact end 8. Inlet 33 of cavity 4 corresponds to an area of cavity 4 near which the electrical connection between the first contact terminal 5 and the second contact terminal 9 is made. Outlet 34 of cavity 4 corresponds to another area of cavity 4 where the first contact terminal 5 is designed to connect with a printed circuit board placed against plug connector 1. At inlet 33 of cavity 4, inner periphery 14 defines a right angle or straight edge 26 against which contact end 8 of the first contact terminal is designed to be supported at rest, electrically disconnected. More precisely, when disconnected, contact end 8 is supported against straight edge 26 of cavity 4 at an area corresponding to a junction between protuberance 12 and the elongated part 16. Contact end 8 is placed so that protuberance 12 is situated outside cavity 4, electrically disconnected. Straight edge 26 can have a rounded edge.

Figure 3:
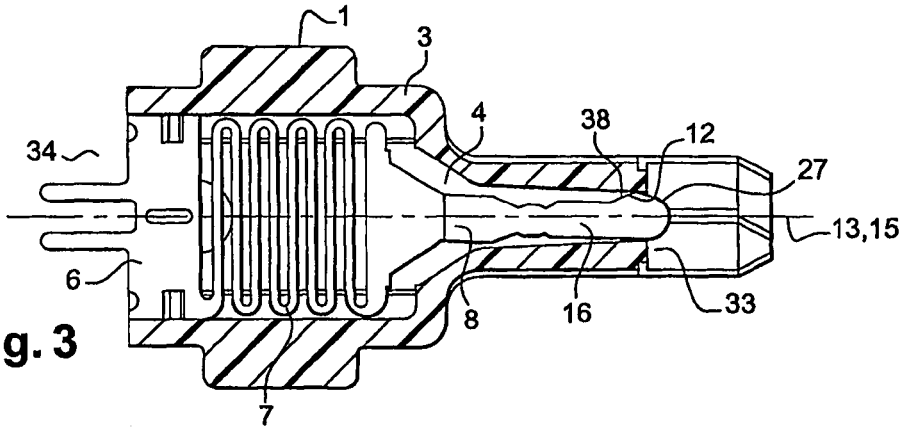
FIG. 3: A sectional view of a plug connector according to the invention during an electrical connection.

During electrical connection, contact end 8 is brought into contact with facial contact end 10 of second contact terminal 9. First contact terminal 5 is then caused to slide inside cavity 4 by compressing intermediate spring part 7 longitudinally relative to connection axis 15 and in the direction of the printed circuit board disposed against plug connector 1. By sliding inside cavity 4, cut-out face 38 is caused to slide against straight edge 26 in such a way that a forced reorientation of elongation axis 13 of elongated part 16 is obtained relatively with regard to connection axis 15. Contact end 8 is reoriented with elongation axis 13 which tends to become parallel to connection axis 15 as the first contact terminal 5 is pushed in the direction of connection end 6. Elongation axis 13 can even be merged with connection axis 15, as shown in FIG. 3. The cut-out face formed by the protuberance permits keeping the first contact terminal in place inside the cavity so as to prevent this same terminal from possibly moving laterally and/or axially relative to the connection axis after it has been electrically connected with the corresponding second contact terminal.

Protuberance 12 is made in such a way that rounded edge 27 of contact terminal 5 defines a first width 20. This first width 20 is measured perpendicularly relative to elongation axis 13 and/or connection axis 15 at an area of the rounded edge 27 where protuberance 12 is positioned. This first width 20 is slightly less than a second width 21 of cavity 4. This second width 21 is measured at an area of the cavity near inlet 33 where contact end 8 is designed to be placed, which second width 21 is measured perpendicularly relative to connection axis 15. When the contact end is pushed into cavity 4, protuberance 12 can come to be wedged against inner periphery 14 of cavity 4 so that rounded edge 27 is in contact with inner periphery 14 of cavity 4. Inner periphery 14 then prevents contact end 8 from rocking relative to connection axis 15 during electrical connection.

Cavity 4 has a part designed to be facing contact end 8, which part is made in such a way that it has an overall conical shape oriented towards inlet 33 of cavity 4. The overall conical shape is created in such a way that elongated part 16 can easily be inclined to the inside of cavity 4 relative to connection axis 15, when electrically disconnected.

A rocking of contact end 8 relative to connection axis 15 is obtained during the sliding of protuberance 12 against straight edge 26 of inner periphery 14. This rocking is produced during the electrical contact and when contact end 8 is pushed in the direction of connection end 6. This rocking permits making a sweeping movement of rounded end 27 of contact end 8 against facial contact end 10 of fixed-base connector 2. This sweeping movement permits removing any dust that might have been deposited on the contact surface delimited by contact end 8 of plug connector 1 and on the other corresponding contact surface delimited by facial contact end 10 of fixed-base connector 2.

After this sweeping movement, the first contact terminal 5 is kept in place inside the cavity due to the forced lateral movement of contact end 8 obtained during electrical connection. After this sweeping movement, first contact terminal 5 can also be kept in place inside the cavity due to the fact that the protuberance is wedged against inner periphery 14 of the cavity during electrical connection.

Figure 4:
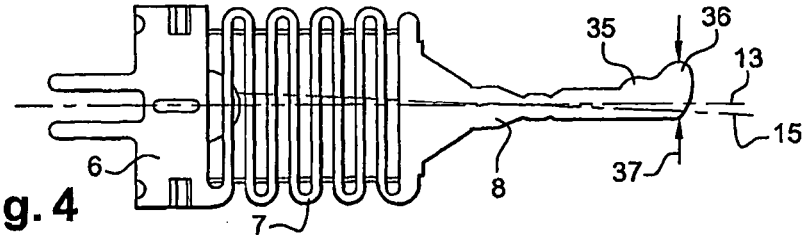
FIG. 4: A schematic representation of one contact end, according to a variant of the invention.

In a variant, FIG. 4, contact end 8 can comprise, along elongation axis 13 and from connection end 6 up to contact end 8, a first protuberance 35 and a second protuberance 36 which are stepped along elongation axis 13. This first protuberance 35 and this second protuberance 36 can be placed one after the other in the same plane from connection end 6 up to contact end 8. The first protuberance 35 is less wide and less extended than the second protuberance 36. Thus, during sliding of first protuberance 35 and then second protuberance 36 against straight edge 26, a first sweeping movement can be obtained followed by a second sweeping movement, respectively. These two sweeping movements assure a better dust removal for each contact surface delimited by contact end 8 of plug connector 1 and by facial contact end 10 of the fixed-base connector 2. The second protuberance 36 defines a third width 37 slightly smaller than the second width 21 of cavity 4, this third width 37 being measured along an axis perpendicular to connection axis 15 and/or elongation axis 13.

Each contact terminal 5 is created after cutting of a metal sheet by stamping. This metal sheet is made in a structure such that it does not deform during electrical connection.

The inventioned claimed is:

1. A plug connector designed to be inserted into a fixed-base connector along a connection axis, comprising an insulating body provided with cavities, each cavity defining an inner periphery, at least one first compression contact terminal, elongated along an elongation axis and designed to be connected to the fixed-base connector by means of a second corresponding contact terminal, the first compression contact terminal being inserted into one of the cavities, and the first contact terminal comprising a connection end designed to be connected to a printed circuit board, an intermediate spring part, and a contact end designed to be connected to the second corresponding contact terminal of the fixed-base connector, wherein the contact end of the first contact terminal comprises at least one protuberance which has a cut-out face to force a lateral movement of the contact end when this protuberance slides against the inner periphery of the cavity, resulting in compression of the intermediate spring part when the contact end is brought into contact with a facial contact end of the second contact terminal, and wherein the first contact terminal is a flat planar member with the protuberance formed at an edge of the flat planar member along a plane of the flat planar member.

2. The connector according to claim 1, wherein the intermediate spring part comprises a series of coils beginning with a first coil and ending with a last coil, the first coil being distant from the contact end, the last coil being near the contact end, the last coil coming to be supported against a shoulder formed in the cavity so as to incline elongation axis relative to connection axis.

3. The connector according to claim 1, wherein the contact end has a first protuberance and a second protuberance which are stepped along the elongation axis.

4. The connector according to claim 3, wherein the first protuberance and the second protuberance of the contact end are placed in the same plane.

5. The connector according to claim 1, wherein the cavity defines an inlet and an outlet, the inlet being an area of the cavity near the contact end and the outlet being an area of the cavity distant from this same contact end, at the inlet of cavity, the inner periphery of the cavity defines a straight edge against which the contact end of the first contact terminal is supported at rest electrically disconnected.

6. The connector according to claim 5, wherein the contact end forms an elongated part terminating with a rounded edge, which edge is provided with the protuberance, the contact end is supported against the straight edge of the cavity in an area corresponding to a junction between the protuberance and the elongated part.

7. The connector according to claim 1, wherein the first contact terminal is made by stamping.

8. The connector according to claim 1 wherein the connection end comprises at least one aperture receiving a projection of the insulating body to fixedly hold the connection end in the insulating body.

9. A plug connector adapted to be inserted into a fixed-base connector along a connection axis, comprising:

an insulating body having a cavity;

a first compression contact terminal, elongated along an elongation axis and adapted to be connected to the fixed-base connector by means of a second corresponding contact terminal of the fixed-base connector, the first compression contact terminal being located in the cavity, wherein the first contact terminal is a flat planar member comprising:

a connection end adapted to be connected to a printed circuit board;

an intermediate spring part; and a contact end adapted to be connected to the second corresponding contact terminal of the fixed-base connector, wherein the contact end of the first contact terminal comprises at least one protuberance which has a cut-out face to force a lateral movement of the contact end when the protuberance slides against a wall of the cavity, resulting in compression of the intermediate spring part when the contact end is brought into contact with a facial contact end of the second contact terminal, and wherein the connection end comprises at least one aperture receiving a projection of the insulating body to fixedly hold the connection end in the insulating body.

10. The connector according to claim 9 wherein the protuberance formed at an edge of the flat planar member along a plane of the flat planar member.

* * * * *